US008251154B2

(12) United States Patent
Duphorne

(10) Patent No.: US 8,251,154 B2
(45) Date of Patent: Aug. 28, 2012

(54) TUBULAR SYSTEM WITH SELECTIVELY ENGAGABLE SLEEVES AND METHOD

(75) Inventor: Darin H. Duphorne, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 565 days.

(21) Appl. No.: 12/535,364

(22) Filed: Aug. 4, 2009

(65) Prior Publication Data

US 2011/0030975 A1 Feb. 10, 2011

(51) Int. Cl.
*E21B 33/12* (2006.01)

(52) U.S. Cl. ..... 166/386; 166/381; 166/194; 166/332.2; 166/318

(58) Field of Classification Search ..... 166/386, 166/194, 381, 318, 330, 331, 332.2, 334.4
See application file for complete search history.

(56) References Cited

U.S. PATENT DOCUMENTS

| | | | | |
|---|---|---|---|---|
| 1,883,071 | A | | 12/1928 | Stone |
| 2,769,454 | A | | 11/1956 | Bletcher et al. |
| 2,812,717 | A | | 11/1957 | Brown |
| 2,822,757 | A | | 2/1958 | Coberly |
| 2,973,006 | A | | 2/1961 | Nelson |
| 3,007,527 | A | | 11/1961 | Nelson |
| 3,013,612 | A | | 12/1961 | Angel |
| 3,148,731 | A | | 9/1964 | Holden |
| 3,211,232 | A | | 10/1965 | Grimmer |
| 3,263,752 | A | | 8/1966 | Conrad |
| 3,358,771 | A | | 12/1967 | Berryman |
| 3,510,103 | A | | 5/1970 | Carsello |
| 3,566,964 | A | | 3/1971 | Livingston |
| 3,667,505 | A | | 6/1972 | Radig |
| 3,703,104 | A | | 11/1972 | Tamplen |
| 3,727,635 | A | | 4/1973 | Todd |
| 3,797,255 | A | | 3/1974 | Kammerer, Jr. et al. |
| 3,901,315 | A | | 8/1975 | Parker et al. |
| 3,997,003 | A | | 12/1976 | Adkins |
| 4,067,358 | A | | 1/1978 | Streich |
| 4,160,478 | A | | 7/1979 | Calhoun et al. |
| 4,176,717 | A | | 12/1979 | Hix |
| 4,190,239 | A | | 2/1980 | Schwankhart |
| 4,246,968 | A | | 1/1981 | Jessup et al. |
| 4,260,017 | A | * | 4/1981 | Nelson et al. ..... 166/154 |
| 4,291,722 | A | | 9/1981 | Churchman |
| 4,292,988 | A | | 10/1981 | Montgomery |

(Continued)

FOREIGN PATENT DOCUMENTS

EP 0427422 A2 5/1991

(Continued)

OTHER PUBLICATIONS

Office Action dated Jun. 25, 2009, in U.S. Appl. No. 11/891,714, U.S. Patent and Trademark Office, U.S.A.

(Continued)

*Primary Examiner* — Daniel P Stephenson
(74) *Attorney, Agent, or Firm* — Cantor Colburn LLP

(57) ABSTRACT

A tubular system with selectively engagable sleeves includes, a tubular, a plurality of sleeves disposed at the tubular, and a plurality of engagable members being movable through the tubular with each of the plurality of engagable members being configurable to selectively engage with at least one of the plurality of sleeves and such engagement at least temporarily preventing passage of an engaged engagable member by an engaged sleeve.

21 Claims, 5 Drawing Sheets

U.S. PATENT DOCUMENTS 4,355,685 A 10/1982 Beck
4,390,065 A 6/1983 Richardson
4,448,216 A 5/1984 Speegle et al.
4,478,279 A 10/1984 Puntar et al.
4,537,383 A 8/1985 Fredd
4,554,981 A 11/1985 Davies
4,566,541 A 1/1986 Moussy et al.
4,576,234 A 3/1986 Upchurch
4,583,593 A 4/1986 Zunkel et al.
4,669,538 A 6/1987 Szarka
4,714,116 A 12/1987 Brunner
4,729,432 A 3/1988 Helms
4,823,882 A 4/1989 Stokley et al.
4,826,135 A 5/1989 Mielke
4,856,591 A 8/1989 Donovan et al.
4,893,678 A 1/1990 Stokley et al.
4,944,379 A 7/1990 Haaser
4,979,561 A 12/1990 Szarka
5,029,643 A 7/1991 Winslow et al.
5,056,599 A 10/1991 Comeaux et al.
5,230,390 A 7/1993 Zastresek et al.
5,244,044 A 9/1993 Henderson
5,297,580 A 3/1994 Thurman
5,305,837 A 4/1994 Johns et al.
5,335,727 A 8/1994 Cornette et al.
5,343,946 A 9/1994 Morrill
5,609,178 A 3/1997 Hennig et al.
5,704,393 A 1/1998 Connell et al.
5,762,142 A 6/1998 Connell et al.
5,775,421 A 7/1998 Duhon et al.
5,775,428 A 7/1998 Davis et al.
5,813,483 A 9/1998 Latham et al.
5,960,881 A 10/1999 Allamon et al.
6,050,340 A 4/2000 Scott
6,053,250 A 4/2000 Echols
6,102,060 A 8/2000 Howlett et al.
6,155,350 A 12/2000 Melenyzer
6,173,795 B1 * 1/2001 McGarian et al. ..... 175/231
6,220,350 B1 4/2001 Brothers et al.
6,227,298 B1 5/2001 Patel
6,253,861 B1 7/2001 Carmichael et al.
6,293,517 B1 9/2001 Cunningham
6,378,609 B1 4/2002 Oneal et al.
6,474,412 B2 11/2002 Hamilton et al.
6,530,574 B1 3/2003 Bailey et al.
6,547,007 B2 4/2003 Szarka et al.
6,634,428 B2 10/2003 Krauss et al.
6,644,412 B2 11/2003 Bode et al.
6,666,273 B2 12/2003 Laurel
6,668,933 B2 12/2003 Kent
6,681,860 B1 1/2004 Yokley et al.
6,712,145 B2 3/2004 Allamon
6,712,415 B1 3/2004 Darbishire et al.
6,834,726 B2 12/2004 Giroux et al.
6,866,100 B2 3/2005 Gudmestad et al.
6,896,049 B2 5/2005 Moyes
6,983,795 B2 1/2006 Zuklic et al.
7,150,326 B2 12/2006 Bishop et al.
7,322,408 B2 1/2008 Howlett
7,325,617 B2 2/2008 Murray
7,337,847 B2 3/2008 McGarian et al.
7,350,578 B2 4/2008 Szarka et al.
7,377,321 B2 5/2008 Rytlewski
7,416,029 B2 8/2008 Telfer et al.
7,467,664 B2 12/2008 Cochran et al.
7,503,390 B2 3/2009 Gomez
7,503,392 B2 3/2009 King et al.
7,520,336 B2 * 4/2009 Mondelli et al. ..... 166/386
7,730,953 B2 6/2010 Casciaro
7,832,472 B2 11/2010 Themig
2001/0007284 A1 7/2001 French et al.
2004/0007365 A1 1/2004 Hill et al.
2005/0061372 A1 3/2005 McGrath et al.
2005/0072572 A1 4/2005 Churchill
2005/0126638 A1 6/2005 Gilbert
2005/0205264 A1 9/2005 Starr et al.
2006/0124310 A1 6/2006 Lopez de Cardenas et al.
2006/0169463 A1 8/2006 Howlett
2006/0175092 A1 8/2006 Mashburn
2006/0213670 A1 9/2006 Bishop et al.
2006/0243455 A1 11/2006 Telfer et al.
2007/0007007 A1 * 1/2007 Themig et al. ..... 166/250.17
2007/0012438 A1 1/2007 Hassel-Sorensen
2007/0023087 A1 2/2007 Krebs et al.
2007/0095538 A1 5/2007 Szarka et al.
2007/0272413 A1 11/2007 Rytlewski et al.
2008/0066924 A1 3/2008 Xu
2008/0093080 A1 4/2008 Palmer et al.
2008/0190620 A1 8/2008 Posevina et al.
2008/0217025 A1 9/2008 Ruddock et al.
2008/0308282 A1 12/2008 Standridge et al.
2009/0032255 A1 2/2009 Surjaatmadja et al.
2009/0044946 A1 2/2009 Schasteen et al.
2009/0044955 A1 2/2009 King et al.
2009/0056934 A1 3/2009 Xu
2009/0056952 A1 3/2009 Churchill
2009/0107680 A1 4/2009 Surjaatmadja
2009/0159289 A1 6/2009 Avant et al.
2009/0308588 A1 12/2009 Howell et al.
2010/0294514 A1 11/2010 Crow et al.
2011/0108284 A1 * 5/2011 Flores et al. ..... 166/373
2011/0180274 A1 7/2011 Wang et al.

FOREIGN PATENT DOCUMENTS

GB 2281924 3/1995
WO 00/15943 3/2000

OTHER PUBLICATIONS

Response to Office Action dated Oct. 15, 2008, in U.S. Appl. No. 11/891,713, U.S. Patent and Trademark Office, U.S.A.

Notice of Allowance & Fees Due and Notice of Allowability dated Jan. 5, 2009, in U.S. Appl. No. 11/891,713, U.S. Patent and Trademark Office, U.S.A.

4. Office Action dated Apr. 9, 2009, in U.S. Appl. No. 11/891,715, U.S. Patent and Trademark Office, U.S.A.

Response to Restriction Requirement dated Apr. 22, 2009 in U.S. Appl. No. 11/891,715, U.S. Patent and Trademark Office, U.S.A.

Office Action dated Jun. 19, 2009, in U.S. Appl. No. 11/891,715, U.S. Patent and Trademark Office, U.S.A.

Notification of Transmittal of the International Search Report and the Written Opinion of the International Searching Authority, Or the Declaration, Feb. 11, 2009, pp. 1-4, PCT/US2008/072732, Korean Intellectual Property Office.

International Search Report, Feb. 11, 2009 pp. 1-3, PCT/US2008/072732, Korean Intellectual Property Office.

Written Opinion of the International Searching Authority, Feb. 11, 2009, pp. 1-3, PCT/US2008/072732, Korean Intellectual Property Office.

Notification of Transmittal of the International Search Report and the Written Opinion of the International Searching Authority, Or the Declaration, Feb. 11, 2009, pp. 1-4, PCT/US2008/072734, Korean Intellectual Property Office.

International Search Report, Feb. 11, 2009, pp. 1-3, PCT/US2008/072734, Korean Intellectual Property Office.

12. Written Opinion of the International Searching Authority, Feb. 11, 2009, pp. 1-4, PCT/US2008/072734, Korean Intellectual Property Office.

Notification of Transmittal of the International Search Report and the Written Opinion of the International Searching Authority, Or the Declaration, Feb. 11, 2009, pp. 1-4, PCT/US2008/072735, Korean Intellectual Property Office.

International Search Report, Feb. 11, 2009, pp. 1-3, PCT/US2008/072735, Korean Intellectual Property Office.

Written Opinion of the International Searching Authority, Feb. 11, 2009, pp. 1-4, PCT/US2008/072735, Korean Intellectual Property Office.

Notification of Transmittal of the International Search Report and the Written Opinion of the International Searching Authority, Or the Declaration, Jan. 19, 2009, pp. 1-4, PCT/US2008/072470, Korean Intellectual Property Office.

International Search Report, Jan. 19, 2009, pp. 1-3, PCT/US2008/072470, Korean Intellectual Property Office.

Written Opinion of the International Searching Authority, Jan. 19, 2009, pp. 1-3, PCT/US2008/072470, Korean Intellectual Property Office.
StageFRAC Maximize Reservoir Drainage, 2007, pp. 1-2, Schlumberger, U.S.A.
Brad Musgrove, Multi-Layer Fracturing Solution Treat and Produce Completions, Nov. 12, 2007, pp. 1-23, Schlumberger, U.S.A.
G.L. Rytlewski, A Study of Fracture Initiation Pressures in Cemented Cased-Hole Wells Without Perforations, May 15, 2006, pp. 1-10, SPE 100572, Society of Petroleum Engineers, U.S.A.
Office Action dated Jul. 16, 2008 in U.S. Appl. No. 11/891,713 U.S. Patent and Trademark Office, U.S.A.
Baker Hughes, Baker Oil Tools, Conventional Fishing Technical Unit; Pump Out Sub Product Family No. H14061, Jun. 7, 2005, 1 page.
Hoffman, C.R., "One-Trip Sand-Control/Liner Hangar/ Big-Bore Completion System," SPE 101086, Sep. 2006, pp. 1-10.
Boscan, J. et al., "Successful Well Testing Operations in High-Pressure/High-Temperature Encironment; Case Histories," SPE 84096, Oct. 2003, pp. 1-15.
Ross, C. M., et al., "Current Materials and Devices for Control of Fluid Loss," SPE 54323, Apr. 1999, pp. 1-16.
International Search Report and Written Opinion; Date of Mailing Aug. 29, 2011; International Application No. PCT/US2011/022523; International Filing Date Jan. 26, 2011; Korean Intellectual Property Office; International Search Report 5 pages; Written Opinion 3 pages.
Notification of Transmittal of the International Search Report and the Written Opinion of the International Searching Authority; PCT/US2011/041663; Korean Intellectual Property Office; Mailed Dec. 14, 2011; 8 pages.
Notification of Transmittal of the International Search Report and the Written Opinion of the International Searching Authority; PCT/US2010/044856; Mailed Apr. 15, 2011.
Notification of Transmittal of the International Search Report and The Written Opinion of the International Searching Authority; PCT/US2010/044383; Mailed Apr. 15, 2011.
International Search Report; PCT/US2010/044399; International Searching Authority KIPO; Mailed Mar. 21, 2011.
Notification of Transmittal of the International Search Report and The Written Opinion of the International Searching Authority; PCT/US2010/054487; International Searching Authority; KIPO; Mailed Jun. 3, 2011.
Notification of Transmittal of the International Search Report and the Written Opinion of the International Searching Authority; PCT/US2010/049810; International Searching Authority KIPO; Mailed Apr. 25, 2011.
International Search Report and Written Opinion of the International Searching Authority; PCT/US2010/044378; Mailed Mar. 17, 2011.
International Search Report; PCT/US2010/033737; Korean Intellectual Property Office; Mailed Jan. 24, 2011.
International Search Report; Date of Mailing Jan. 24, 2011; International Appln No. PCT/US2010/034736; 3 Pages.
International Search Report; Date of Mailing Jan. 24, 2011; Internatiaonal Appln. No. PCT/US2010/034752; 3 Pages.
Nternational Search Report and Written Opinion; Date of Mailing Feb. 11, 2011; International Appln No. PCT/US2010/041049; International Search Report 5 Pages and Written Opinion 3 Pages.

* cited by examiner

TUBULAR SYSTEM WITH SELECTIVELY ENGAGABLE SLEEVES AND METHOD

BACKGROUND

The ability to selectively open ports along a tubular has applications in various industries. For example, in industries involving boreholes into earth formations, tubulars positioned within the borehole may have ports therealong that are originally closed but are desired to be opened individually and selectively. Systems have been developed that allow an operator to pump a ball to a ball seat sized to sealably engage the ball. Once engaged, pressure can be applied to move the ball seat and a sleeve attached thereto until the sleeve uncovers a previously covered port through the tubular. Such systems, however, have inherent dimensional restrictions due to the variously sized ball seats needed to engage the variously sized balls. Additionally, these systems can only open the ports in an ever upstream moving sequence due the fact that larger balls cannot pass through a smaller dimensioned seat. Systems that overcome the foregoing drawbacks are desirable in the art.

BRIEF DESCRIPTION

Disclosed herein is a tubular system with selectively engagable sleeves. The system includes, a tubular, a plurality of sleeves disposed at the tubular, and a plurality of engagable members being movable through the tubular with each of the plurality of engagable members being configurable to selectively engage with at least one of the plurality of sleeves and such engagement at least temporarily preventing passage of an engaged engagable member by an engaged sleeve.

Further disclosed herein is a method of selectively engaging sleeves within a tubular. The method includes, moving an engagable member within a tubular, contacting one of a plurality of sleeves disposed at the tubular with the engagable member, rotationally orienting the engagable member relative to the one of a plurality of sleeves, and selectively engaging a stop on one of the engagable member and the one of the plurality of sleeves with an engaging detail on the other of the engagable member and the one of the plurality of sleeves.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
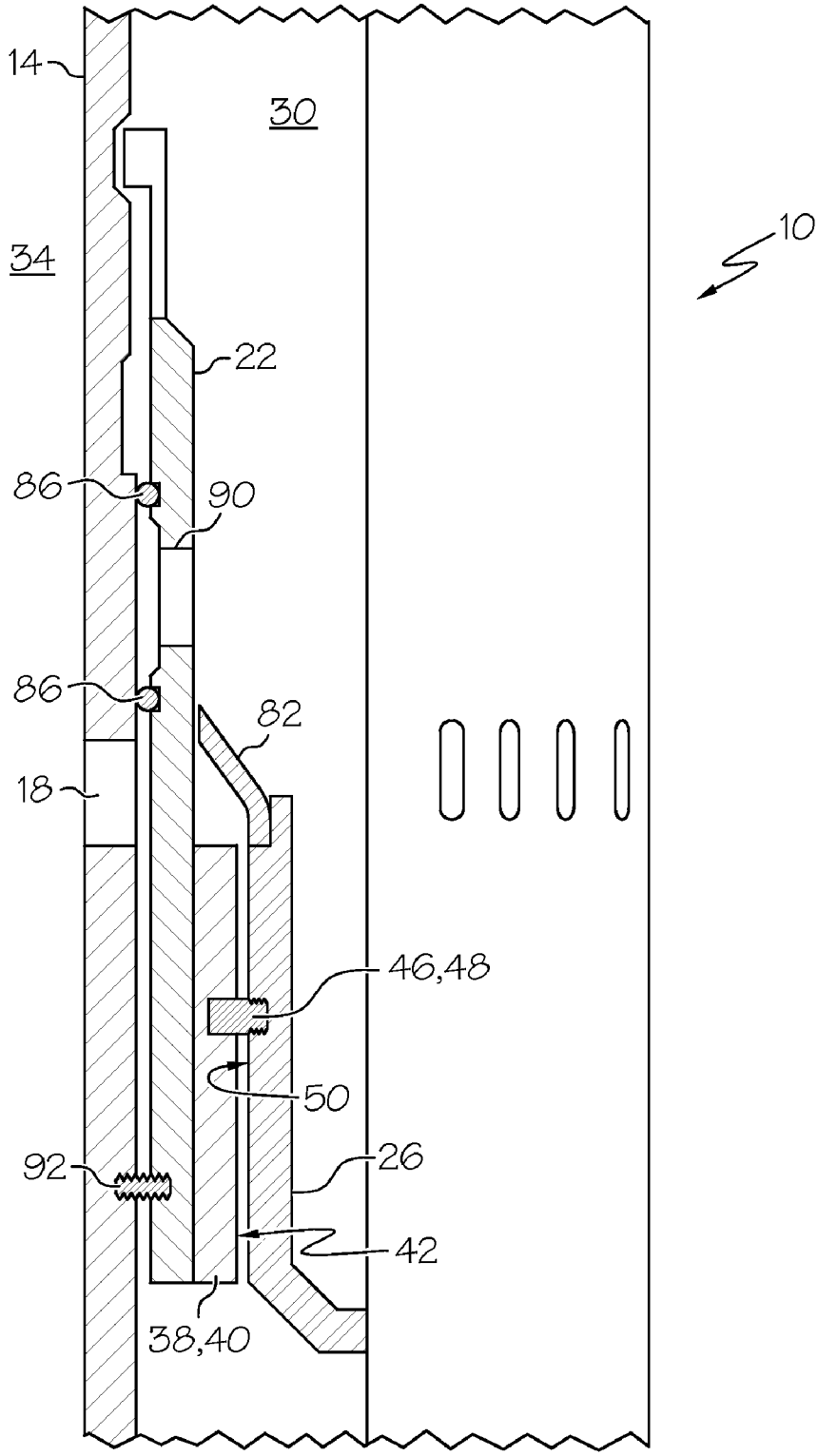
FIG. 1 depicts a partial quarter cross sectional view of a tubular system with selectively engagable sleeves disclosed herein.

Referring to FIG. 1, an embodiment of a tubular system with selectively engagable sleeves is generally illustrated at 10. The tubular system 10 includes, a tubular 14, having a plurality of ports 18, a plurality of sleeves 22 disposed at the tubular 14, with one of the sleeves 22 being illustrated herein, and a plurality of engagable members 26, disclosed herein as plugs, movable within the tubular 14. The plugs 26 can be moved within tubular 14, by such methods as dropping or pumping, for example, causing them to move therethrough and to sequentially encounter the sleeves 22 in the process. Details on the sleeves 22 and plugs 26, as will be described below, allow each plug 26 to either, selectively pass through each sleeve 22 encountered or, to engage the sleeve 22 and become, at least temporarily, attached thereto. Attachable engagement between the plug 26 and the sleeve 22 allow an operator to perform an operation such as, to move the sleeve 22 thereby opening at least one of the ports 18 to allow fluid communication from an inside 30 of the tubular 14 to an outside 34 of the tubular 14, for example. The plugs 26 and the sleeves 22 can be configured so that the plug 26 can movably engage any one of the particular sleeves 22 regardless of the location of the sleeve 22 along the tubular 14.

Figure 2:
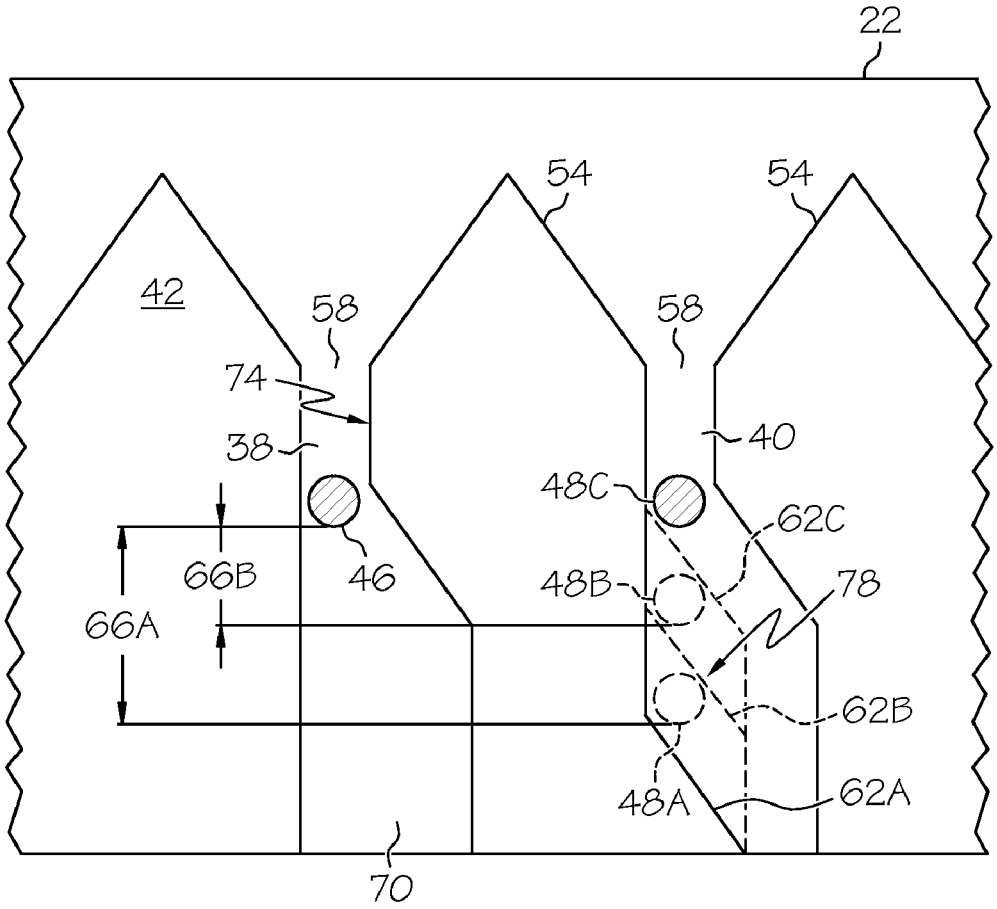
FIG. 2 depicts a partial cross sectional view of slots on an inner surface of the sleeve of FIG. 1 with the sleeve illustrated in an unrolled configuration, pins of an engagable member are shown engaged within the slots.

In this embodiment, each of the sleeves 22 has multiple slots 38, 40, with two being illustrated herein, formed in a radially inwardly facing surface 42 thereof. Each of the plugs 26 has a generally cylindrical shape and multiple pins 46, 48, protruding from a radially outwardly facing surface 50 thereof. The surfaces 42 and 50 are sized to allow the plug 26 to slidably move within the sleeve 22. The pins 46, 48 protrude from the surface 50 and are routed through the slots 38, 40. Angled surfaces 54 at the entry to each slot 38, 40, as best seen in FIG. 2, cause the plugs 26 to rotate relative to the sleeves 22 as the pins 46, 48 are funneled along the surfaces 54 until they engage with the slots 38, 40, thereby rotationally orienting the plug 26 relative to the sleeve 22. Alternate embodiments could have these features reversed, for example, and have the pins 46, 48 located on the radially inwardly facing surface 42 of the sleeve 22 while the slots 38, 40 are formed in the radially outwardly facing surface 50 of the plugs 26.

Referring to FIG. 2, the radially inwardly facing surface 42 is shown as if the sleeve 22 has been unrolled to illustrate the interaction between the pins 46, 48 and the slots 38, 40. Only the pins 46, 48 of the plug 26 are shown and not the body of the plug 26 so as to not obstruct or complicate the view. A number of pins 46, 48 is selected to be equal to or fewer than a number of slots 38, 40 with specifically two pins 46, 48 and two slots 38, 40 being illustrated herein. An angular spacing of the pins 46, 48 about a perimeter of the plug 26 is set to correspond with an angular spacing of an entryway 58 of each of the slots 38, 40 about a perimeter of the sleeve 22 to assure that each pin 46, 48 enters one of the slots 38, 40.

Each of the slots 40 has a helical portion 62A-62C that defines a key for selective engagement with at least one of the plugs 26. Complementarily, each of the plugs 26 has a longitudinal offset 66A or 66B between at least the two pins 46 and 48A, or between the two pins 46 and 48B, respectively that define a key for selective engagement with at least one of the sleeves 22. This keying between one of the plugs 26 and one of the sleeves 22 is based on the longitudinal relationship between the helical portions 62A-62C and the longitudinal offsets 66A, 66B, respectively. For example, a plug 26 having the longitudinal offset 66A, 66B, or no offset at all can pass through a sleeve 22 having the helical portion 62A. This is easily observable by visualizing rotation of the plug 26 caused by the helical portions 62A-62C as the plug 26 passes through the sleeve 22. As the pin 48A, 48B or 48C contacts helical portion 62A it will cause the plug 26 to rotate relative to the sleeve 22 thereby resulting in the pin 46 also rotating relative to the slot 38. Since the slot 38 has a wide portion 70 in longitudinal alignment with the helical portions 62A-62C, the pin 46 is free to rotate into the wide portion 70 thereby allowing the plug 26 to pass through the sleeve 22.

Similarly, the plug 26 having pins 46 and 48B or 48C will pass through the sleeve 22 having the helical portion 62B, however, the plug having pins 46 and 48A will not pass through the sleeve 22 with the helical portion 62B. The plug 26 is prevented from passing by contact of the pin 46 with a wall 74 of the slot 38 that results when the plug 26 attempts to rotate in response to contact of the pin 48A with a wall 78 of the helical portion 62B. The foregoing construction allows for a near limitless number of keys to control passage or blockage of the plugs 26 by the sleeves 22 by, for example, adding more pins 48 and more helical portions 62 through increases in a longitudinal length of the plugs 26 and the sleeves 22. Also, a plurality of the slots 40 can be positioned around the perimeter of the sleeve 22 to increase the number of selectable keys that are possible for a given longitudinal length.

Additionally, the pins 46 or 48 can be made to release at selected load levels, by shearing, for example. Doing so can allow for an actuation to be undertaken at a first load and then release of the plug 26 at a second load. For example, seals 82 can sealingly engage with the sleeve 22 thereby allowing pressure thereabove to build producing a load on the plug 26 and the sleeve 22 to move the sleeve 22. Such a movement could open ports 18 by moving seals 86 on the sleeve 22 that straddle ports 90 to also straddle the ports 18 thereby allowing fluid communication between the inside 30 of the tubular 14 and the outside 34. Movement of the sleeve 22 relative to the tubular 14 can be prevented until a threshold force is achieved, such a threshold force can be set by a releasable member 92, such as a shear screw, that fixedly attaches the sleeve 22 to the tubular 14. This system can also allow high pressure to be used in a fracturing operation.

Figure 3:
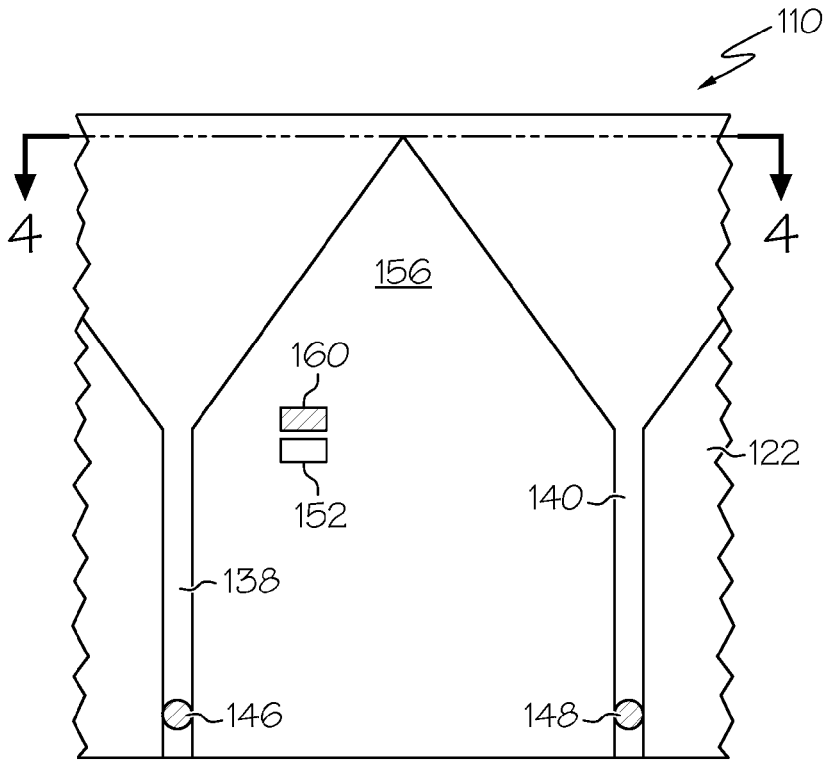
FIG. 3 depicts an alternate embodiment of a sleeve disclosed herein in an unrolled configuration similar to that of FIG. 2.
Figure 4:
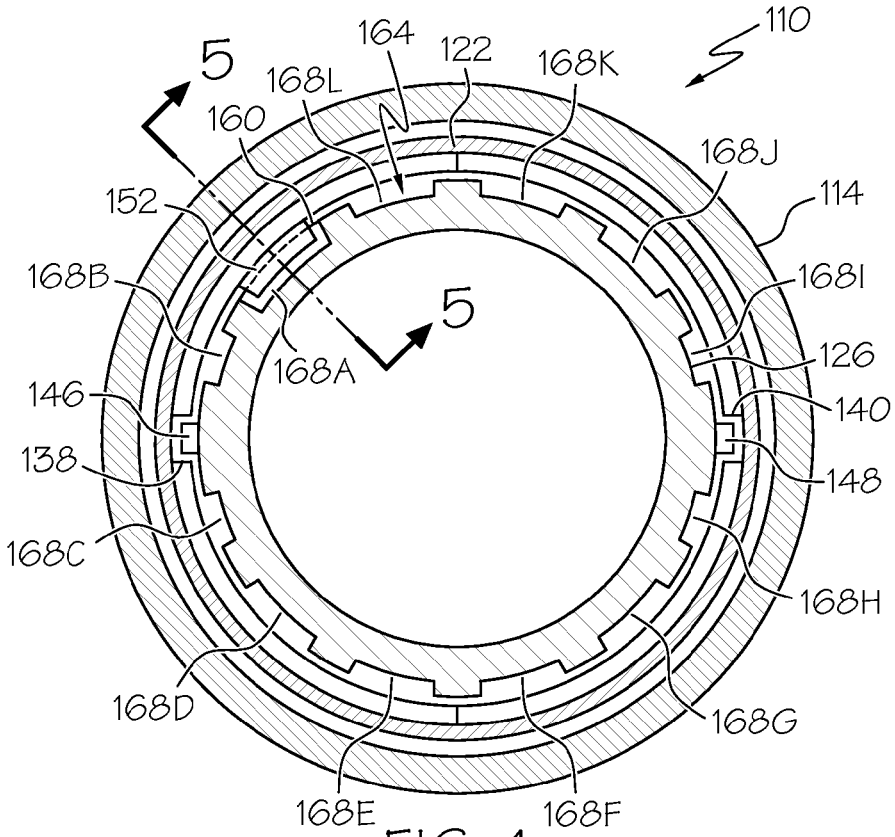
FIG. 4 depicts a top cross sectional view of the tubular system of FIG. 3 taken at arrows 4-4.
Figure 5:
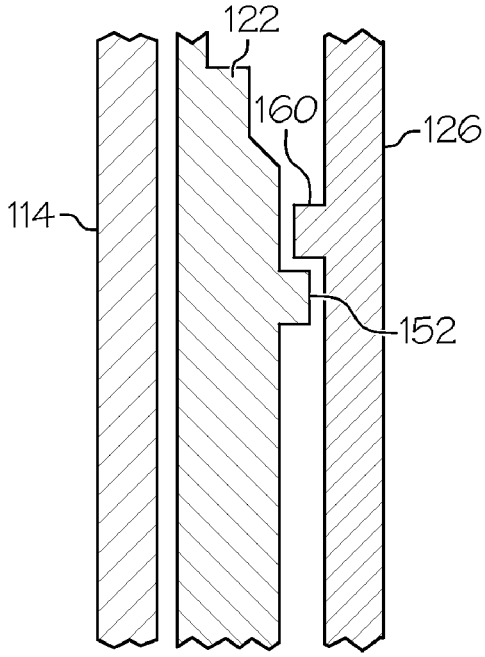
FIG. 5 depicts a partial cross sectional view of the tubular system of FIG. 4 taken at arrows 5-5.

Referring to FIGS. 3, 4 and 5, an alternate embodiment of a tubular system with selectively engagable sleeves is illustrated at 110. The tubular system 110 includes, a tubular 114, a plurality of sleeves 122 disposed at the tubular 114, with just one of the sleeves 122 being illustrated herein, and a plurality of engagable members 126, illustrated herein as plugs, selectively engagable with the sleeves 122. As in the tubular system 10 the tubular system 110 has slots 138, 140 on the sleeves 122 receptive of pins 146, 148 on the plugs 126 that rotationally align the plug 126 with the sleeve 122. Unlike the system 10 however, the system 110 does not have the helical portions 62 to cause a rotation of the plug 126. Instead a keying arrangement of the system 110 includes stops 152, on an inner surface 156 of the sleeves 122, that when rotationally aligned with an engaging detail 160, shown herein as a tab on an outer surface 164 of the plugs 126 prevent passage of the plug 126 through the sleeve 122. Since the plugs 126 are rotationally aligned with the sleeves 122, by the pins 146, 148 engaging within the slots 138, 140, a plurality of rotational positions 168A-168L, with twelve being illustrated in this embodiment, can be used to allow or prevent passage of a plug 126 through a particular sleeve 122. The keying arrangement is simply controlled by selective inclusion of the stops 152 and the engaging detail 160 within a common rotational position 168A-168L.

Figure 6:
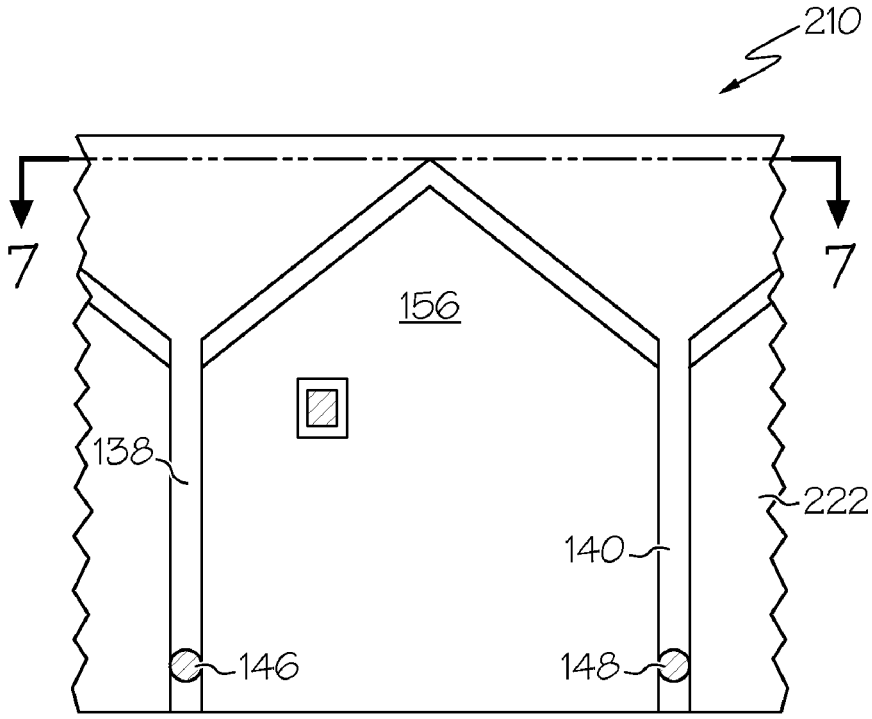
FIG. 6 depicts a sleeve disclosed herein in an unrolled configuration similar to that of FIG. 2 of an alternate embodiment of tubular system with selectively engagable sleeves.
Figure 7:
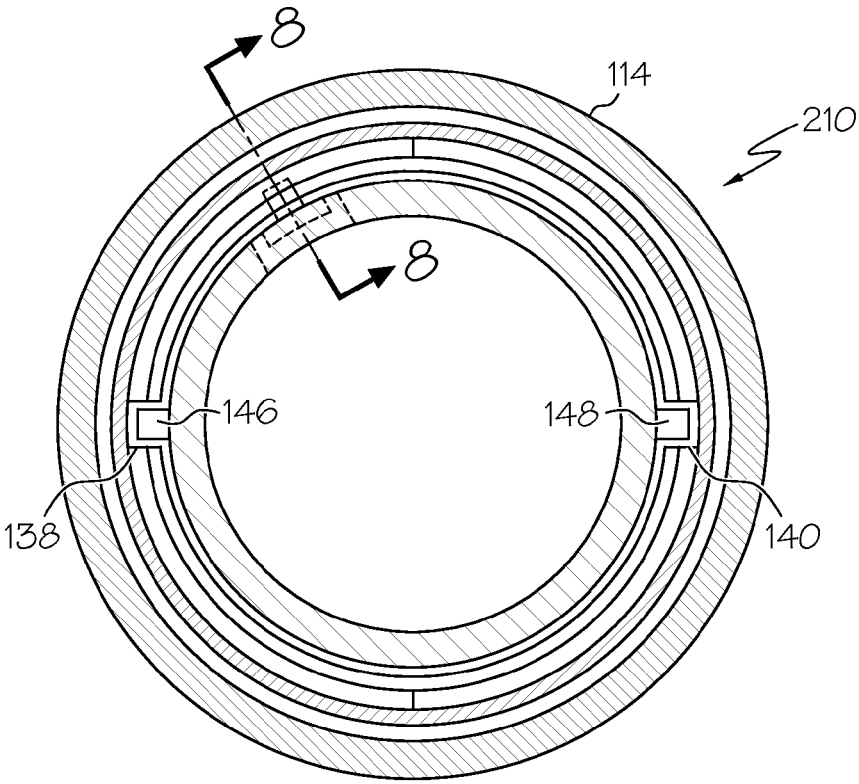
FIG. 7 depicts a top cross sectional view of the tubular system of FIG. 6 taken at arrows 7-7.
Figure 8:
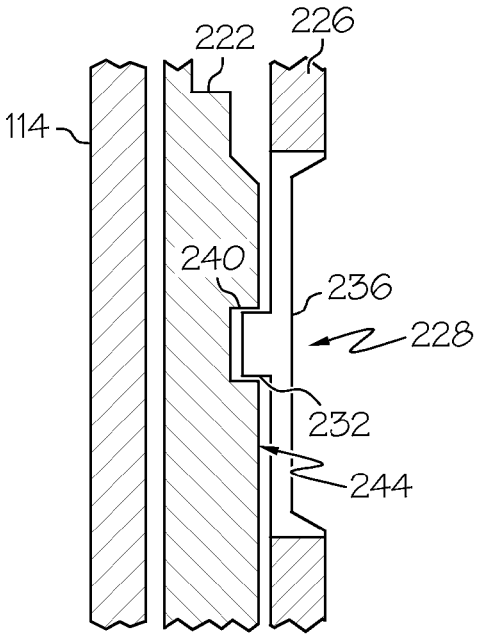
FIG. 8 depicts a partial cross sectional view of the tubular system of FIG. 6 taken at arrows 8-8.

Referring to FIGS. 6-8, an alternate embodiment of a tubular system with selectively engagable sleeves is illustrated at 210. The tubular system 210 is similar to the tubular system 110 and as such only the primary differences will be described herein in detail. The tubular system 210 includes, the tubular 114, a plurality of sleeves 222 disposed at the tubular 114, with just one of the sleeves 222 being illustrated herein, and a plurality of engagable members 226, disclosed herein as plugs, movable within the tubular 114 and selectively engagable with the sleeves 222. The plugs 226 are rotationally aligned with the sleeves 222 by pins 146, 148 that engage within slots 138, 140. A deformable portion 228 of the plug 226, as best illustrated in FIG. 8, has a protrusion 232 that extends radially outwardly from leg 236 that is engagable within a recess 240 formed in an inner radial surface 244 of the sleeve 222. As such, the keying arrangement herein is defined by selective rotational alignment of the protrusion 232 on the plug 226 with the recess 240 of the sleeve 222, which prevents passage of the plug 226 by the sleeve 222. It should be noted that in alternate embodiments the location of the protrusion 232 and the recess 240 could be reversed in that the protrusion 232 could be located on the sleeve 222 and the recess 240 located on the plug 226.

Figure 9:
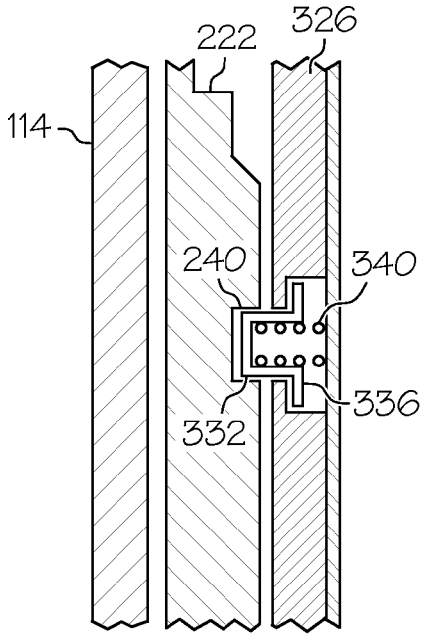
FIG. 9 depicts a partial cross sectional view similar to the view of FIG. 8 of an alternate embodiment of a tubular system with selectively engagable sleeves.

Referring to FIG. 9, an alternate embodiment of an engagable member 326 is disclosed herein. The engagable member 326, as illustrated herein is a plug. The plug 326 is engagable with the sleeve 222 in a similar manner as the plug 226 is engagable with the sleeve 222. The primary difference between the plug 326 and the plug 226 is that the plug 326 has protrusions 332 that are positioned on dogs 336 that are biased radially outwardly of the plug 326 by biasing members 340, illustrated herein as compression springs. The protrusions 332 are engagable within the recess 240 to prevent passage of the plug 326 through the sleeve 222. As such, the keying is defined by selective rotational alignment of the protrusion 332 on the plug 326 with the recess 240 on the sleeve 222.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A tubular system with selectively engagable sleeves, comprising:

a tubular;

a plurality of sleeves disposed at the tubular; and a plurality of engagable members being movable through the tubular with each of the plurality of engagable members being configurable to selectively engage with at least one of the plurality of sleeves and such engagement at least temporarily preventing passage of an engaged engagable member by an engaged sleeve and one of the plurality of sleeves and the plurality of engagable members have a plurality of slots receptive to a plurality of pins protruding from a surface of the other of the plurality of sleeves and the plurality of engagable members.

2. The tubular system with selectively engagable sleeves of claim 1, wherein the plurality of engagable members are configured to selectively pass some of the plurality of sleeves.

3. The tubular system with selectively engagable sleeves of claim 1, wherein the plurality of slots and the plurality of pins are configured to cause relative rotation of one of the plurality of engagable members selectively passable through one of the plurality of sleeves to rotate as a selectively passable engagable member travels longitudinally through the one of the plurality of sleeves.

4. The tubular system with selectively engagable sleeves of claim 3, wherein a longitudinal offset of the plurality of pins is matched by a longitudinal offset of the plurality of slots.

5. The tubular system with selectively engagable sleeves of claim 3, wherein at least one of the plurality of pins is defeatable to allow passage of one of the plurality of engagable members engaged with one of the plurality of sleeves to pass upon defeat of the one of the plurality of pins.

6. The tubular system with selectively engagable sleeves of claim 5, wherein the one of the plurality of pins is a shear pin.

7. The tubular system with selectively engagable sleeves of claim 1, wherein the plurality of slots are configured to prevent one of the plurality of engagable members selectively engaged with one of the plurality of sleeves from passing therethrough.

8. The tubular system with selectively engagable sleeves of claim 7, wherein a longitudinal offset of the plurality of pins differs from a longitudinal offset of the plurality of slots.

9. The tubular system with selectively engagable sleeves of claim 1, wherein the plurality of engagable members are sealable to the plurality of sleeves with which they are selectively engagable.

10. The tubular system with selectively engagable sleeves of claim 1, wherein the plurality of sleeves are longitudinally fixed to the tubular by a releasable member.

11. The tubular system with selectively engagable sleeves of claim 1, wherein forces are generated by pressure applied against one of a selectively engagable member and an engaged sleeve.

12. The tubular system with selectively engagable sleeves of claim 1, wherein the plurality of engagable members are plugs.

13. A tubular system with selectively engagable sleeves, comprising:

a tubular;

a plurality of sleeves disposed at the tubular; and a plurality of engagable members being movable through the tubular with each of the plurality of engagable members being configurable to selectively engage with at least one of the plurality of sleeves and such engagement at least temporarily preventing passage of an engaged engagable member by an engaged sleeve and the plurality of engagable members are rotationally oriented relative to the plurality of sleeves and selective engagement includes an engaging detail on one of the plurality of engagable members and the plurality of sleeves interferingly engagable with a stop on the other of the plurality of engagable members and the plurality of sleeves to prevent passage of the engaging detail beyond the stop.

14. The tubular system with selectively engagable sleeves of claim 13, wherein the engaging detail is a key.

15. The tubular system with selectively engagable sleeves of claim 13, wherein the engaging detail is biased dog and the stop is a recess.

16. The tubular system with selectively engagable sleeves of claim 13, wherein the engaging detail is a deformable member and the stop is a recess.

17. A method of selectively engaging sleeves within a tubular, comprising:

moving an engagable member within a tubular;

contacting one of a plurality of sleeves disposed at the tubular with the engagable member;

rotationally orienting the engagable member relative to the one of a plurality of sleeves; and selectively engaging a stop on one of the engagable member and the one of the plurality of sleeves with an engaging detail on the other of the engagable member and the one of the plurality of sleeves.

18. The method of selectively engaging sleeves within a tubular of claim 17, wherein the moving the engagable member includes at least one of dropping and pumping.

19. The method of selectively engaging sleeves within a tubular of claim 17, further comprising selectively passing one of the plurality of sleeves disposed at the tubular with the engagable member.

20. The method of selectively engaging sleeves within a tubular of claim 17, further comprising defeating a releasable member that selectively engages the one of a plurality of engagable members with the one of the plurality of sleeves.

21. The method of selectively engaging sleeves within a tubular of claim 17, wherein the selectively engaging includes differing a longitudinal offset between pins on one of the engagable member and the one of the plurality of sleeves with respect to slots on the other of the engagable member and the one of the plurality of sleeves.

* * * * *